US005119558A

United States Patent [19]

van Erp et al.

[11] Patent Number: 5,119,558

[45] Date of Patent: Jun. 9, 1992

[54] SHAVING APPARATUS

[75] Inventors: Wilhelmus P. M. M. van Erp; Theo T. de Jong, both of Drachten, Netherlands

[73] Assignee: U.S. Philips Corp., New York, N.Y.

[21] Appl. No.: 612,951

[22] Filed: Nov. 13, 1990

[30] Foreign Application Priority Data

Nov. 14, 1989 [NL] Netherlands ..... 8902807

[51] Int. Cl.[5] ..... B26B 19/38

[52] U.S. Cl. ..... 30/43.6; 30/346.51

[58] Field of Search ..... 30/43.5, 43.6, 43.9, 30/346.51

[56] References Cited

U.S. PATENT DOCUMENTS 2,533,979 12/1950 Vivie ..... 30/43.6
4,151,645 1/1979 Tietjens ..... 30/43.6
4,998,352 3/1991 Tietjens ..... 30/43.6

*Primary Examiner*—Douglas D. Watts
*Attorney, Agent, or Firm*—Ernestine C. Bartlett

[57] ABSTRACT

A shaving apparatus is provided having at least one cutting unit comprising an external cutting member and an internal cutting member which is rotatable relative to the external cutting member, the external cutting member being formed with elongate hair-entry apertures, the longitudinal bounding walls of an aperture being substantially parallel. In order to improve the shaving performance the bounding walls of a hair-entry aperture are inclined from the outside towards the inside in the driving direction.

2 Claims, 3 Drawing Sheets

SHAVING APPARATUS

FIELD OF THE INVENTION

The invention relates to a shaving apparatus having at least one cutting unit comprising an external cutting member and an internal cutting member which is rotatable relative to the external cutting member, the external cutting member being formed with elongate hair-entry apertures, the longitudinal bounding walls of an aperture being substantially parallel.

BACKGROUND OF THE INVENTION

Such an apparatus is disclosed in U.S. Pat. No. 2,877,548. In this prior-art apparatus the longitudinal bounding walls of a hair-entry aperture are inclined from the outside towards the inside in a direction opposite to the driving direction. The object of this is to provide an improved support and positioning of a hair to be cut by the external cutting member. Moreover, this yields a sharp cutting edge at the inner side of the external cutting member and the facing bounding wall also terminates in a sharp edge at the outer side of the external cutting member, which enhances the erection of hairs which lie flat against the skin.

It has been found that this prior-art construction performs less satisfactorily, which may be explained by the fact that the inclined bounding surface supporting the hair during cutting exerts an outwardly directed force on the hair or the skin area surrounding the hair. This force pushes the hair outwards so that it is not severed over an optimum length.

The hair-entry apertures employed in practice almost exclusively have bounding walls oriented transversely of the driving direction, as shown in FIG. 1 of said U.S. Pat. No. 2,877,548.

SUMMARY OF THE INVENTION

The invention aims at improving the performance of shaving apparatus of the type defined hereinbefore and is characterized in that the bounding walls of a hair-entry aperture are inclined from the outside towards the inside in the driving direction.

Some exemplary embodiments of the invention will now be described in more detail with reference to the Figures.

DESCRIPTION OF THE PREFERRED EMBODIMENTS

Figure 1:
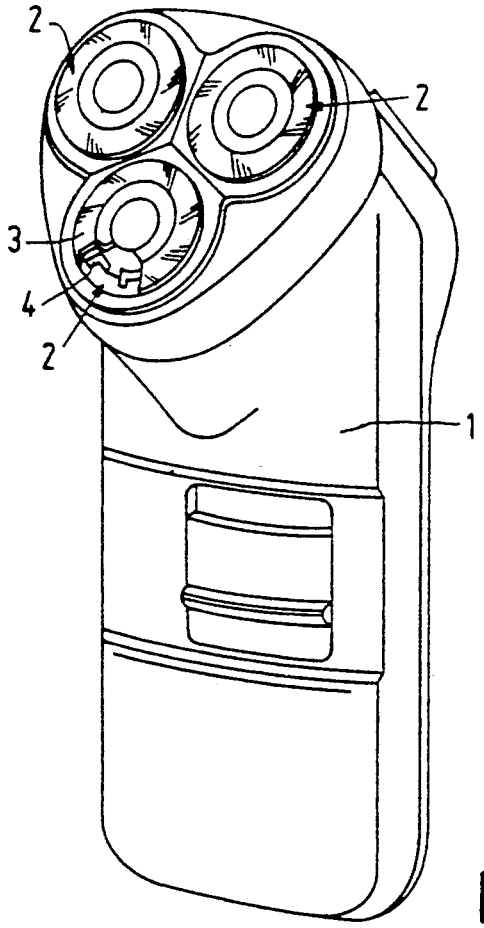
FIG. 1 is a perspective view of a shaving apparatus having three cutting units.

The shaving apparatus shown in FIG. 1 comprises a housing 1 having three cutting units 2.

Figure 2:
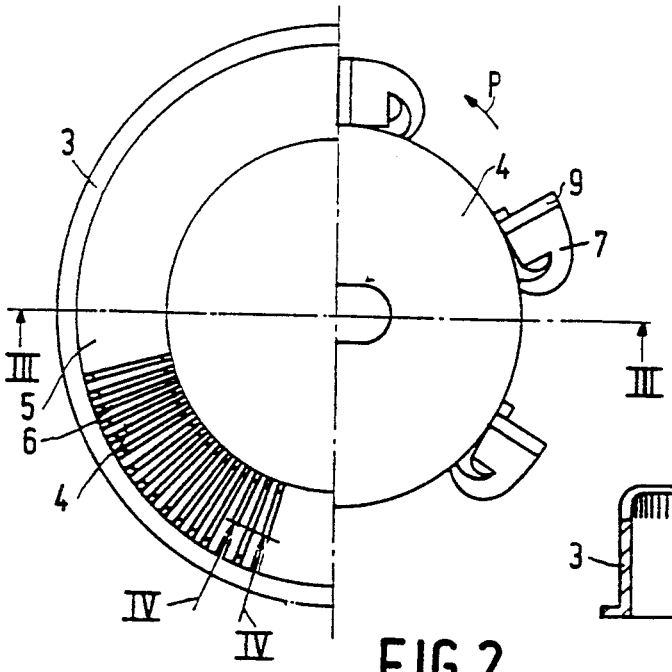
FIG. 2 is a plan view of a cutting unit, in which the external cutting member is not shown in the right-hand half of the Figure.
Figure 3:
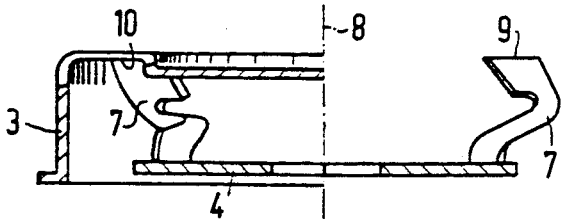
FIG. 3 is a sectional view taken on the line III—III in FIG. 2, only two cutting elements being shown for the sake of clarity.

A cutting unit (FIGS. 2 and 3) comprises an external cutting member 3 and an internal cutting member 4 which can be driven to rotate relative to the external cutting member 3. The internal cutting member can be driven in a manner known per se by an electric motor accommodated in the housing 1.

The external cutting member 3 has a flat circular wall portion 5 having longitudinal substantially radially directed hair-entry apertures 6. The internal cutting member 4 comprises cutting elements 7 which extend substantially in axial directions relative to the axis of rotation 8 of the internal cutting member, the ends 9 of the cutting elements 7 engaging against the inner wall 10 of the external cutting member 3.

An aperture 6 (FIGS. 4 to 7) is mainly bounded by wall portions 11 and 12 of the two bridges 13 between which the aperture 6 is situated, which wall portions extend in the longitudinal direction of the aperture.

During use of the shaving apparatus the outer wall 14 of the external cutting member 3 will be in contact with the skin 15. When a hair 16 is caught in a hair-entry aperture 6 it will be severed by the cooperation between a bridge 13 and a cutting element 7.

Figure 4:
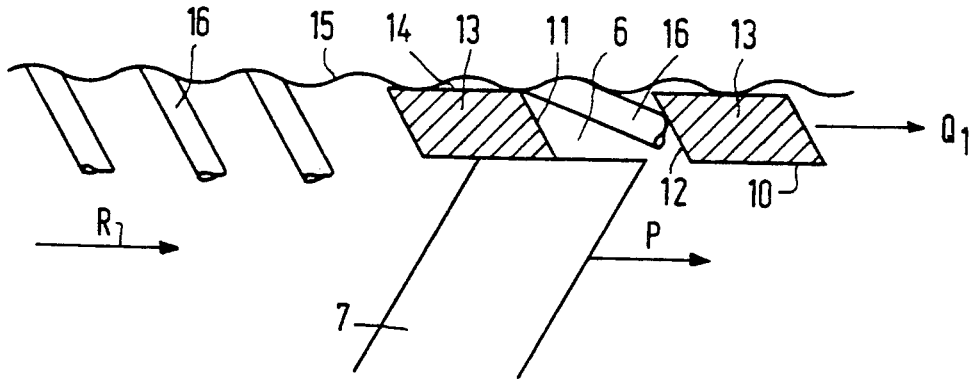
FIGS. 4 to 7 show a part of the cutting unit in enlarged-scale sectional views taken on the line IV—IV in FIG. 2 and also show a part of the skin, to illustrate the operation of the shaving apparatus.

As is shown in FIG. 4, the bounding walls 11 and 12 of the hair-entry aperture 6 are inclined from the outside towards the inside, i.e. from the outer wall 14 towards the inner wall 10, in the driving direction P.

The hairs 16 of the skin 15 to be shaved generally do not extend perpendicularly to the skin. Moreover, it occurs frequently that almost all the hairs on skin areas to be shaved, for example facial hairs, have the same direction R (FIGS. 4, 5 and 6) which deviates from said non-perpendicular orientation.

It has been found that a hair-entry aperture 6 can contribute effectively to the shaving process if the shaving apparatus is moved over the skin in such a manner that the longitudinal direction of the hair-entry aperture extends transversely of the direction of movement. However, if this direction of movement $Q_1$ coincides with the hair direction R (FIG. 4) the hairs 16 will be flattened against the skin and will not be shaved.

Figure 5:
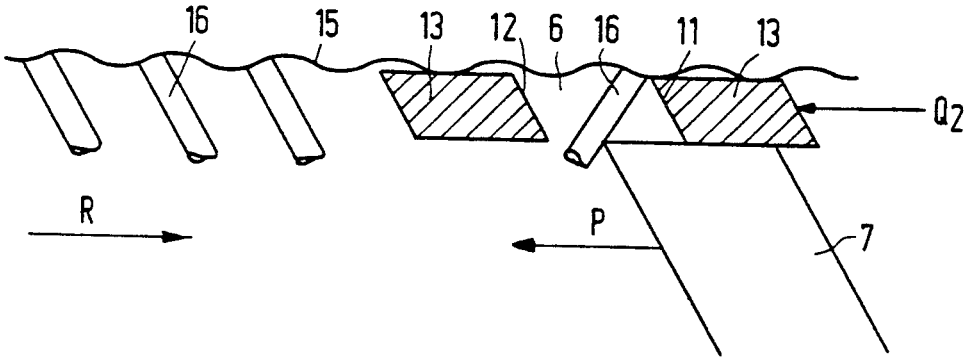

In the situation illustrated in FIG. 5 the direction of movement $Q_2$ of the hair-entry aperture 6 is opposed to the direction R of the hairs and the driving direction P of the cutting element 7 is also opposed to R. The shaving performance is now also poor because the hair 16 caught in the hair-entry aperture 6 is initially supported by the wall portion 11 and must be pushed to the facing wall portion 12 by the cutting element 7 before the hair can be severed by the cutting element 7 and the bridge 13 associated with the wall portion 12. As a result of this displacement the hair 16 is oriented obliquely and urged outwards at least partly, so that only a small portion of the hair is severed or the hair is not severed at all.

In principle, the effects described with reference to FIGS. 4 and 5 are independent of the shape of the hair-entry apertures 6, i.e. they occur also if the bounding walls 11 and 12 are directed transversely of the driving direction P.

Figure 6:
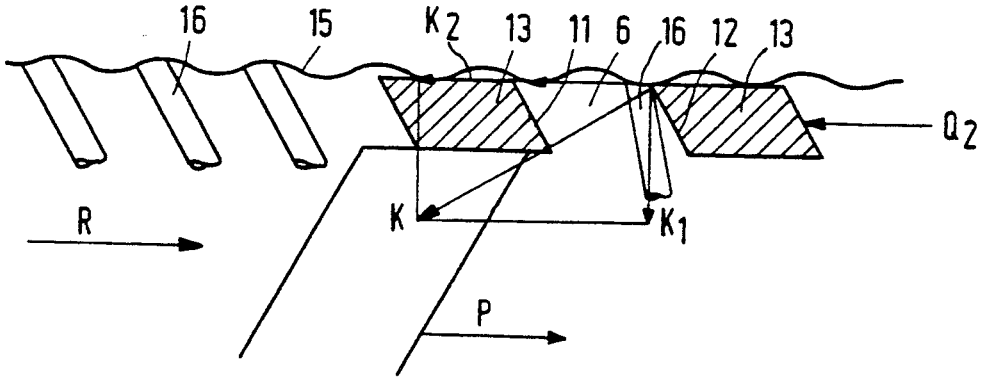
Figure 7:
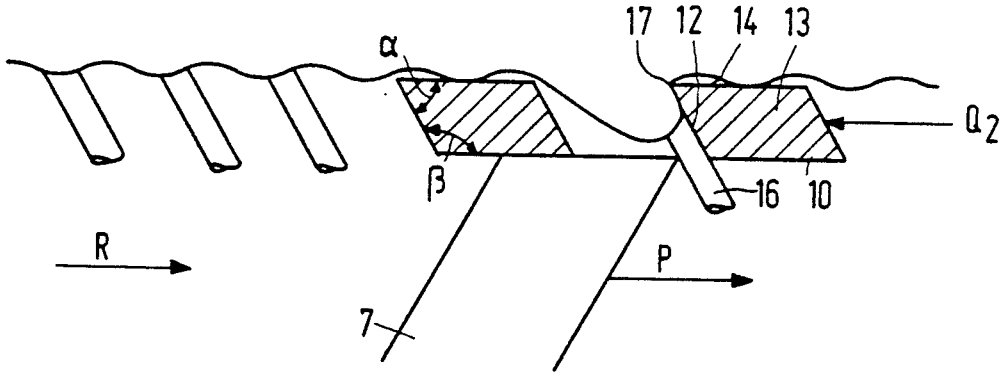

In the situation shown in FIGS. 6 and 7 the hair-cutting conditions are optimum. The direction of movement $Q_2$ of a hair-entry aperture 6 is opposite to the direction R of the hairs 16. The cutting element 7 is driven in a direction corresponding to R. The inclined bounding wall 12 exerts a normal force K with components $K_1$ and $K_2$ on a hair 16 caught in the hair-entry aperture 6 and, if applicable, on the surrounding area of the skin 15. The component $K_1$ has an axially inward direction, causing the hair 16 to be pushed further inwards from the situation shown in FIG. 6 to the situation shown in FIG. 7, in which the cutting element 7 has reached the hair 16 and is severed. Since the skin 15 is pushed inwards and the hair 16 is pushed into the aperture 6 by the inclined bounding wall 12 a larger part of the hair 16 is severed than with the prior-art constructions, yielding a better shaving result.

The bounding wall 12 and the upper wall 14 define a sharp edge 17 on the bridge 13, which for the direction of movement $Q_2$ increases the likelihood of the edge 17 engaging underneath flattened hairs, so that they are erected and severed.

The construction is preferably such that in a sectional view as shown in FIGS. 4 to 7 a bridge 13 is shaped substantially as a parallelogram, preferably with acute angles $\alpha$ of between 50° and 80° and obtuse angles $\beta$ of between 100° and 180°.

Figure 8:
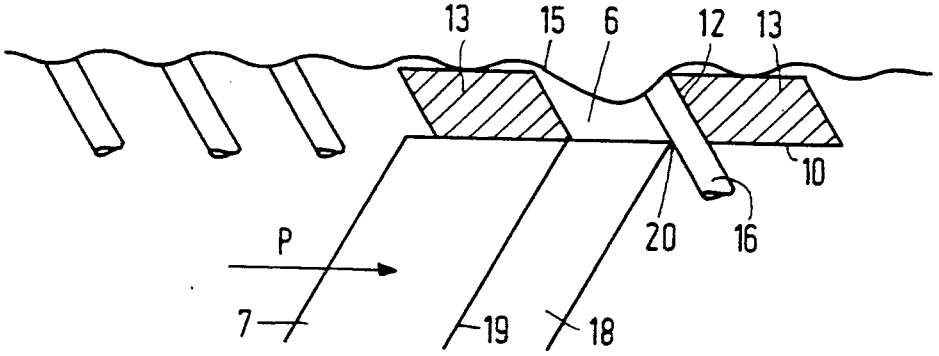
FIGS. 8 and 9 show a modification of the apparatus shown in FIGS. 1 to 7 in sectional views corresponding to those in FIGS. 4 to 7.
Figure 9:
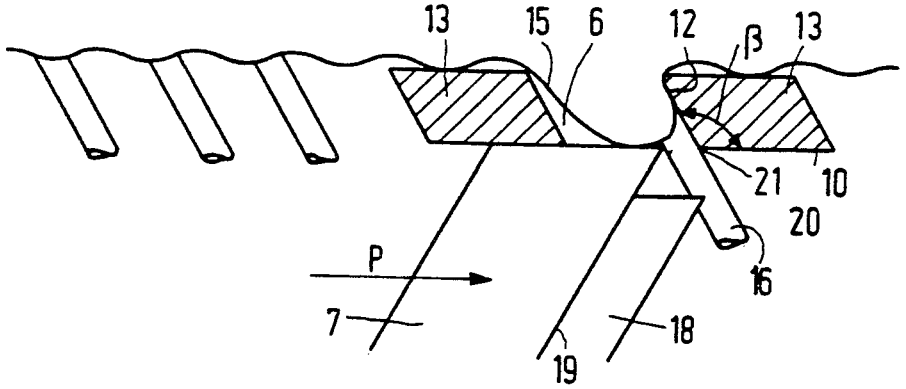

FIGS. 8 and 9 relate to an embodiment in which the cutting element 7 has been provided with a hair-pulling element which is known per se. This hair-pulling element is also driven in the direction P but is movable relative to the cutting element 7 along the front wall 19 of said cutting element. When the hair-pulling element 18 meets a hair 16 (FIG. 8) the hair-pulling element will slide along this front wall 19. The edge 20 of the hair-pulling element 18 has slightly penetrated the hair 16 so that the hair 16 and possibly the surrounding area of the skin 15 are pulled further into the hair-entry aperture 6 by the hair-pulling element (FIG. 9). The cutting element can now sever the hair 16 over substantially its entire length.

The inclined bounding wall 12 promotes this inward displacement of the hair 16 as a result of the action of the hair-pulling element because the bounding wall is inclined from the inside towards the outside in the driving direction P. Therefore, as is illustrated in FIG. 6, a normal force K exerted on the hair 16 by the bounding wall 12 will have an inwardly directed component $K_1$.

Moreover, the bounding wall 12 and the inner wall 10 define an edge 21 of the bridge 13 having a cross-sectional angle $\beta$ which is obtuse, thereby reducing the likelihood of the hair 16 being caught by this edge 21.

The above shape of the hair-entry apertures also has the advantage that if an end of a cutting element 7 or of a hair-pulling element 18 is caught in a hair-entry aperture 6 this end is automatically pushed out of the aperture by said force $K_1$ owing to the inclined shape of the wall portion 12.

The hair-entry apertures with an inclined shape can be formed simply using customary techniques such as cutting, spark erosion or laser processing.

We claim:

1. A shaving apparatus having at least one cutting unit comprising an external cutting member and an internal cutting member which is rotatable relative to the external cutting member, the external cutting member being formed with elongate hair-entry apertures, the longitudinal bounding walls of an aperture being substantially parallel, characterized in that the bounding walls of a hair-entry aperture are inclined from the outside towards the inside in the driving direction.

2. A shaving apparatus as claimed in claim 1, characterized in that in a sectional view perpendicular to its longitudinal direction a ridge situated between two hair-entry apertures has substantially the shape of a parallelogram.

* * * * *